United States Patent [19]

Enderlin

[11] Patent Number: 5,070,585

[45] Date of Patent: Dec. 10, 1991

[54] APPARATUS FOR CONTINUOUS HEAT TREATMENT OF TEXTILE THREAD

[75] Inventor: Robert Enderlin, Morschwiller Le Bas, France

[73] Assignee: Passap Knitting Machines, Inc., Salt Lake City, Utah

[21] Appl. No.: 558,141

[22] Filed: Jul. 25, 1990

[30] Foreign Application Priority Data

Jul. 26, 1989 [FR] France ..... 89 10275

[51] Int. Cl.[5] ..... D02J 13/00

[52] U.S. Cl. ..... 28/220

[58] Field of Search ..... 28/220; 68/5 D, 5 E

[56] References Cited

U.S. PATENT DOCUMENTS

| | | | |
|---|---|---|---|
| 2,142,722 | 1/1939 | Dreyfus et al. | 68/5 D |
| 2,427,054 | 9/1947 | Jackson et al. | 68/5 D |
| 2,833,136 | 5/1958 | Prince et al. | 68/5 D |
| 4,346,503 | 8/1982 | Sando et al. | 68/5 D X |
| 4,426,746 | 1/1984 | Sando et al. | 68/5 E X |
| 4,718,257 | 1/1988 | Reimehr et al. | 68/5 E |
| 4,754,619 | 7/1988 | Keith | 68/5 E |
| 4,760,629 | 8/1988 | Paulini et al. | 68/5 D X |
| 4,949,558 | 8/1990 | Enderlin | 68/5 E |

FOREIGN PATENT DOCUMENTS

| | | | |
|---|---|---|---|
| 2584430 | 1/1987 | France | 68/5 D |

*Primary Examiner*—Werner H. Schroeder
*Assistant Examiner*—John J. Calvert
*Attorney, Agent, or Firm*—Davis, Bujold & Streck

[57] ABSTRACT

The invention concerns an apparatus for continuous heat treatment of textile thread. The apparatus is designed as a modular unit so that its size may be adapted to each need and treatment parameters adjusted according to its application. The apparatus comprises a conveyor belt (1) transporting thread (13) through a pretreatment chamber (7) and a treatment chamber (8). Each of these chambers (7, 8) comprises one or more enclosure modules (20, 30) containing one or more forced circulation units (21, 31). In the pretreatment chamber (7), each unit (21) causes pretreatment fluid to circulate in a closed circuit. The units (31) in the treatment chamber (8) cause treatment fluid to circulate and may function as an open circuit. Such an apparatus is useful for continuous heat treatment of textile thread, particularly for heat fixing either the physical structure of the thread or dyes.

9 Claims, 2 Drawing Sheets

APPARATUS FOR CONTINUOUS HEAT TREATMENT OF TEXTILE THREAD

The present invention concerns an apparatus for continuous heat treatment of textile thread, comprising an endless conveyor belt, at least one depositing station for continuously placing the thread in the form of a sheet of continuous, connected spirals onto the conveyor belt, a heat treatment enclosure traversed by the conveyor belt and by the thread thereon, and removal means for removing the thread from the belt, the heat treatment enclosure comprising at least one pretreatment chamber containing pretreating fluid, specifically air or a mixture of air and steam, and a treatment chamber containing a treatment fluid essentially composed of saturated steam.

Saturated steam heat treatment is applied to numerous types of thread, either to set dye or to impart a certain structure to synthetic thread, particularly to puff it up. In the various apparatus applying these treatments there are a certain number of principal devices which are similar, but which vary in size from one apparatus to another. In particular, the length of the various enclosures varies considerably, as it depends upon several parameters such as the length of treatment in each chamber, the gradual temperature variation throughout the circuit followed by the thread, and conveyor belt speed, dictated by the capacity of the apparatus. As a result, the producer of such an apparatus is faced with obvious difficulties in producing and maintaining an inventory of parts.

Furthermore, the presence of two or more consecutive chambers with different conditions (type of fluid, temperature, pressure) requires separation means through which the thread will be able to pass. This leads to complications in manufacture and prolongs the length of the apparatus. For example, French Patent Application published as No. 2 307 202 describes a watertight device sustaining a pressure differential between two enclosures traversed by a continuous belt through which different fluids are passed. The device comprises, along the belt, a corridor forming a sort of dam into which is injected a barrier gas which is neutral in relation to the treatment fluid. This gas flows toward the two enclosures and is then evacuated with the treatment fluids. In this device, the problem of adapting the treatment parameters in each enclosure remains the same.

The present invention proposes to overcome the above described disadvantages with an apparatus easily adaptable to different applications and to the various corresponding treatment parameters by virtue of differently sized pretreatment and treatment chambers.

The basic principle of the invention consists of the modular construction of these two chambers. More specifically, the invention concerns an apparatus of the type described above, characterized in that the pretreatment chamber comprises at least one enclosure module containing at least one unit for forced circulation of pretreatment fluid, in that the treatment chamber comprises at least one enclosure module containing at least one unit for forced circulation of treatment fluid, and in that each of the said forced circulation units comprises a casing mounted inside the enclosure module and traversed by the conveyor belt, said casing defining a circuit provided with a ventilator and disposed to cause the pretreatment or treatment fluid to circulate through the sheet of thread spirals without the fluid leaving the corresponding chamber.

This combination of modular enclosure construction and forced circulation units recycling the fluid in a closed circuit inside each chamber permits pretreatment and treatment to be individually tailored, despite the use of standard size enclosure modules. Actually, on-site adaptation of pretreatment and treatment parameters, particularly the gradual variation in thread temperature along its course, is achieved simply by adjusting the function parameters of the forced circulation units in each chamber.

Depending upon the embodiment, the pretreatment chamber may comprise one or more consecutive enclosure modules and each of these modules may contain one or more forced circulation units for pretreatment fluid.

In the same manner, the treatment chamber may comprise one or more consecutive enclosure modules, and each of these modules may contain one or more forced circulation units for treatment fluid.

Preferably, the circuit with the ventilator is essentially transversely disposed with respect to the displacement direction of the thread, so as to effect lateral recycling of the fluid which has traversed the conveyor belt and the sheet of thread spirals.

Each of the said forced treatment fluid circulation units may comprise an open circuit having its own ventilator and communicating with a common vapor production device in the treatment chamber.

Pretreatment and treatment may take place at atmospheric pressure or at a higher pressure, depending upon need.

The treatment chamber may be connected to the pretreatment chamber by a passage with at least one valve opening for the conveyor belt and the thread thereon.

In an advantageous embodiment, the apparatus comprises a cooling chamber composed of an enclosure module containing at least one forced circulation unit for air or a mixture of air and steam.

The present invention and its advantages will be more apparent in the following description of one exemplary embodiment, with reference to the attached drawings, wherein.

Figure 1:
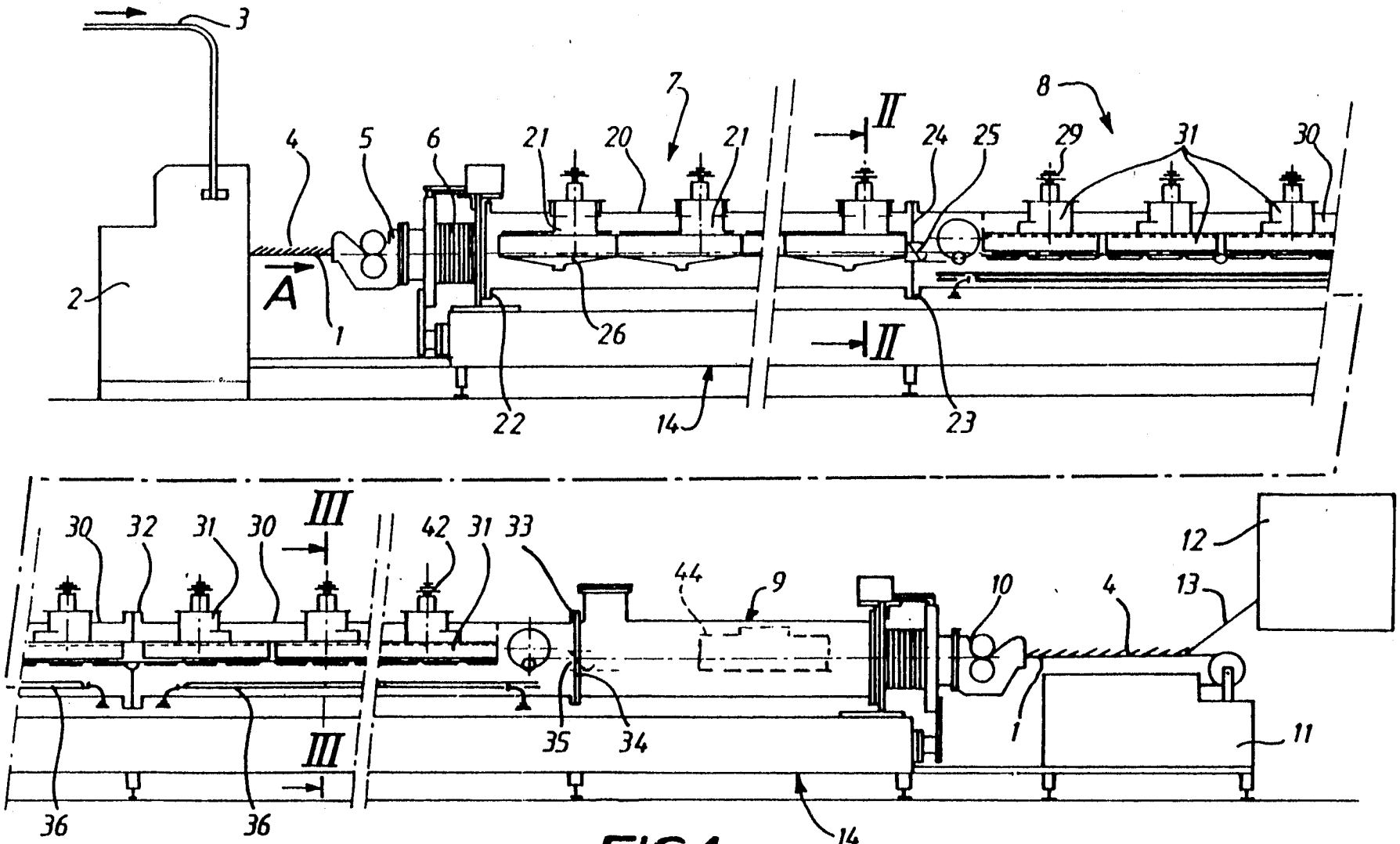
FIG. 1 is a lateral schematic view, partially in section, of a textile thread heat treatment apparatus according to the invention.

With reference to the drawings, the apparatus shown is designed for continuous heat fixing of thread, particularly synthetic textile thread for the carpet industry, which is placed on a continuous conveyor belt 1 circulating in the direction of Arrow A. Heat fixing may be used to set the physical structure of the thread, to crimp it, puff it up, increase its volume, cause it to retract, stabilize it or set dyes. Belt 1 is perforated so that a current of pretreatment or treatment fluid can pass through it; it may be made of a perforated strip of galvanized steel, for example. The principal devices situated along the path of the conveyor are:

a deposit means 2 continuously receiving one or more parallel textile threads through a guide 3 and placing them on belt 1 in the form of connected spirals 4 which are consecutive and continuous, forming a sheet of threads of a certain thickness;

a watertight seal 5 which may consist of pressure rollers;

a bellows 6 forming part of seal 5;

a pretreatment chamber 7 where the preliminary heat treatment phase takes place;

a treatment chamber 8 where saturated pressurized steam treatment of the thread takes place in the case shown;

a cooling chamber 9 where the thread undergoes progressive cooling;

a watertight exit seal 10 which may be a roller-type seal;

a chassis 11 with a return roller for the conveyor belt; and a continuous takeup device 12 and a device 13 for winding the thread taken by the latter device on belt 1.

Of course, this is a schematic disposition which shows only the principal organs, which have control and drive units as are known in this type of apparatus. Depending upon need, the apparatus may also include other treatment means such as, for example, drying means, and mechanical manipulation devices, for example, a thread storage device disposed at the belt exit.

Pretreatment chamber 7 has a modular construction. In this example it comprises a sole enclosure module 20 forming a cylindrical, watertight tunnel and containing several forced circulation units 21 for pretreatment fluid, the construction of each of these units being essentially similar, disposed in succession along the path of belt 1. Enclosure module 20 is impermeably connected to watertight seal 5 by attachment means 22 and to treatment chamber 8 by fastening means 23 with a transverse partition 24 having a valve opening 25 for the passage of belt 1 and the thread it holds.

Each unit 21 comprises a compartment 26 surrounding belt 1 which passes therethrough, a ventilator 27 controlled by a motor 28 whose speed is regulated by means of transmission 29 disposed outside chamber 7, and a return conduit 30 for receiving pretreatment fluid at the exit of ventilator 27 and recycling it by introducing it into compartment 26 beneath belt 1, so that the pretreatment fluid again flows over the sheet of threads on the belt. Therefore, there is practically a closed circuit in unit 21, which is obviously not sealed in the area where the belt passes, and which may for example comprise lateral openings for communication with the rest of the interior of enclosure module 20. In the closed circuit, pretreatment fluid composition and temperature are permanently controlled by captors such as 45, allowing the control unit to adjust treatment parameters to the desired values, particularly steam temperature and amount or degree of heating. Depending upon need, this may be accomplished by introducing hot or cold air, by introducing steam, by engaging or regulating a heating unit placed on the circuit, by modifying ventilator speed, etc.

The design and function of a forced circulation unit of this type are described in more detail in French Patent Application No. FR-A-2.569.277, describing a progressive heating chamber for continuous heat treatment of thread.

Even though the basic construction is preferably the same, the different units 21 can respectively provide different conditions for the thread, particularly regarding temperature and humidity. Certain ones may circulate only air, others a mixture of air and steam, the latter being provided by an exterior generator. Progressive treatment may also be applied to the thread, thereby avoiding heat shock.

In practice, enclosure module 20 is dimensioned to hold a number of units 21 ranging from one to a predetermined maximum. If pretreatment chamber 7 needs to be longer or must accommodate a greater number of units 21, a second or even third enclosure module 20 may be added. Units 21 may be spread out among the modules in any appropriate fashion, especially in a sole series of contiguous units if necessary.

Treatment chamber 8, in this instance known as the steam chamber, is also constructed in modular fashion. In this example, it comprises two enclosure modules 30 each containing several forced circulation units 31 for treatment fluid, in this case consisting of saturated steam. The two modules 30 are joined end to end by a sealed fastening assemblage 32, the second module 30 being attached to the cooling chamber 9 by a fastening assemblage 33 comprising a compartment 34 with a valve opening 35 for belt 1. In this example, the lower portion of each enclosure module 30 contains a steam generator 36 formed by electrical heating units in a water bath 37. In principle, heat fixing of dyes in saturated pressurized steam in chamber 8 takes place in the absence of air (pure saturated steam) at predetermined temperatures ranging, for example, from 110° to 150° C. depending upon the quality of thread to be treated. With an apparatus constructed according to the principles described herein, these parameters may easily be adapted to different applications.

Figure 3:
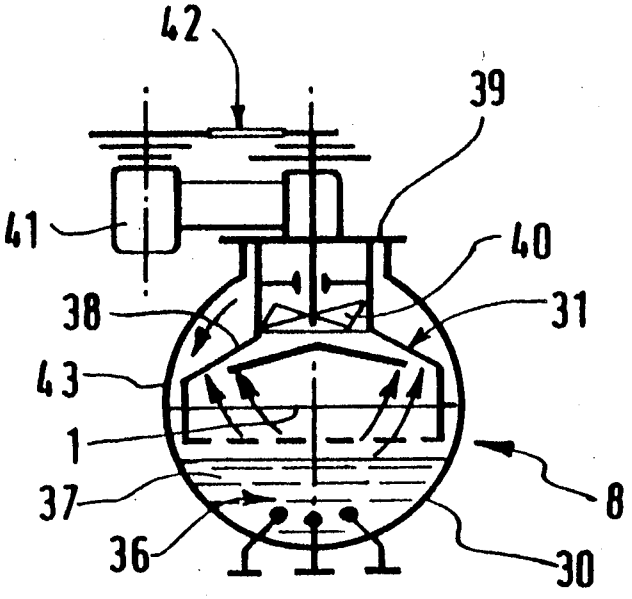
FIG. 3 is a schematic transverse cross section taken along line III—III of FIG. 1.
Figure 2:
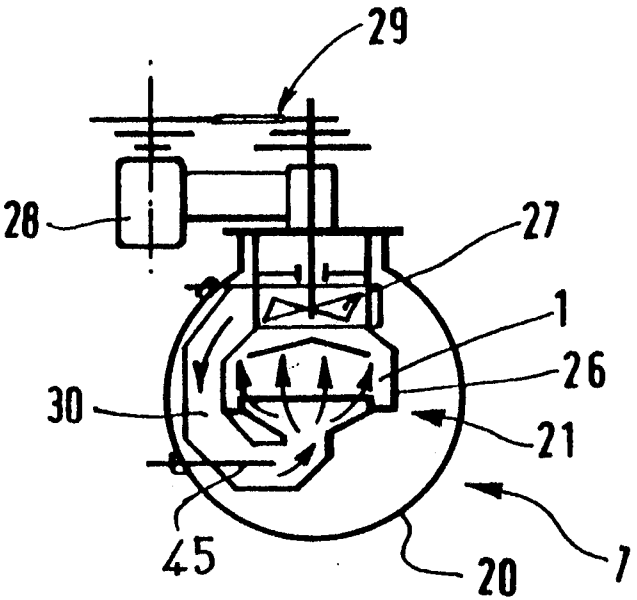
FIG. 2 is a schematic transverse cross section taken along line II—II of FIG. 1.

In chamber 8, forced circulation units 31 function as open circuits in this example, as is seen in particular in FIG. 3. Each unit has a compartment 38 which surrounds the conveyor belt 1 and has a perforated lower portion to allow the steam from the generator to enter. The upper portion of compartment 38 is suspended from a cover 39 attached to enclosure 30, and contains a ventilator 40 controlled by a motor 41 by means of a variable or adjustable speed transmission 42. Steam emitted by ventilator 40 flows downward toward the steam generator through lateral passageways 43 so that it is recycled essentially within the same unit 31, even though the circuit is open near the bottom. The speed of ventilators 40 on the different units 31 may be individually regulated to optimize treatment by using different flow rates for different treatment fluids in each unit. Because the steam is laterally recycled, a slight temperature difference may also be maintained between the first and second enclosure module 30 if desired.

As described above with respect to pretreatment chamber 7, the modular construction of steam chamber 8 allows its size and equipment to be easily adapted to a particular type of treatment, as well as to the desired treatment speed, length of time within the chamber and speed of belt advancement. Each enclosure module 30 may contain a suitable number of units 31, ranging from one to a maximum determined by the length of the elements. In certain cases, satisfactory treatment may result from using only one enclosure module 30 containing a sole forced circulation unit 31 for treatment fluid, with the thread simply being liberally exposed to the treatment fluid, for example, to saturated steam, in the remainder of its circuit through steam chamber 8.

Cooling chamber 9 comprises the same elements as pretreatment chamber 7. In principle it contains only air or a mixture of air and steam, ensuring gradual thread cooling. To enhance cooling, it may contain one or more forced circulation units 44.

The preceding description shows that the modular construction according to the invention has the advantage of satisfying a large number of different treatment conditions in the different applications for which such an apparatus is used, using a limited number of standard components. Furthermore, the use of several forced circulation units along the thread circuit allows heat treatment parameters to be modified at will and the treatment process to be adapted to different thread qualities by merely changing control parameters, without modifying or replacing the components of the apparatus.

The present invention is not restricted to the non-limiting example described above, but extends to all modifications or variations obvious to one skilled in the art.

I claim:

1. An apparatus for continuous heat treatment of a textile thread, said apparatus comprising an endless conveyor belt (1), at least one depositing station for continuously placing the textile thread, in the form of a sheet of continuous spirals, on said endless conveyor belt, a heat treatment enclosure being traversed by said endless conveyor belt and by the textile thread to be conveyed thereon, and a takeup device for removing the textile thread from said endless conveyer belt, the heat treatment enclosure comprising at least one pretreatment chamber (7) containing a pretreatment fluid, specifically air or a mixture of air and steam, and a treatment chamber (8) containing a treatment fluid comprising saturated steam, wherein said at least one pretreatment chamber (7) comprises at least one enclosure module (20) containing at least one autonomous and internal forced circulation unit (21) for the pretreatment fluid, and the treatment chamber (8) comprises at least one enclosure module (30) containing at least one autonomous and internal forced circulation unit (31) for the treatment fluid, and each of said autonomous and internal forced circulation units (21, 31) comprises an internal compartment (26, 38) mounted inside each of said enclosure modules (20, 30) and traversed by said endless conveyor belt (1), each said compartment defines a flow circuit for each forced circulation unit and is provided with a ventilator (27, 40) disposed to cause one of the pretreatment fluid and treatment fluid to circulate in each said forced circulation unit, via the flow circuit, through the textile thread while retaining the fluid in each respective chamber (7, 8).

2. An apparatus according to claim 1, wherein said flow circuits are substantially transversely disposed in relation to a travel direction of textile thread so as to effect lateral recycling of the fluid which has traversed said endless conveyor belt (1) and the textile thread during heat treatment.

3. An apparatus according to claim 1, wherein each of the treatment chamber forced circulation units comprise an open circuit having dedicated ventilator means (40) communicating with a common steam producing device (36, 37) in the treatment chamber (8).

4. An apparatus according to claim 1, wherein the treatment chamber (8) is connected to the at least one pretreatment chamber (7) by a passage with at least one opening (25) for said endless conveyor belt and the textile thread to be carried on said endless conveyor belt.

5. An apparatus according to claim 1, further comprising a cooling chamber (9) consisting of an enclosure module containing at least one autonomous and internal forced circulation unit (4) for air for cooling the textile thread to carried by said endless conveyor belt.

6. An apparatus according to claim 1, further comprising a cooling chamber (9) consisting of an enclosed module containing at least one autonomous and internal forced circulation unit (4) for a mixture of air and steam for cooling the textile thread carried by said endless conveyor belt.

7. An apparatus according to claim 1, wherein each said forced circulation unit (21) of the at least one pretreatment chambers comprises a substantially closed circuit having dedicated ventilator means (27).

8. An apparatus for continuous heat treatment of a textile thread, said apparatus comprising:

an endless conveyor belt (1);

at least one depositing station for continuously placing the textile thread on said endless conveyor belt;

a heat treatment enclosure being traversable by said endless conveyor belt and by the textile thread to be conveyed thereon, the heat treatment enclosure comprising a pretreatment chamber (7) containing a pretreatment fluid, and a treatment chamber (8) containing a treatment fluid; and a takeup device for removing the textile thread from said endless conveyer belt after passing through the heat treatment enclosure;

wherein the pretreatment chamber (7) comprises at least one enclosure module (20) containing at least one autonomous and internal forced circulation unit (21) for the pretreatment fluid, and the treatment chamber (8) comprises at least one enclosure module (30) containing at least one autonomous and internal forced circulation unit (31) for the treatment fluid, and each of said autonomous and internal forced circulation units (21, 31) comprises an internal compartment (26, 38) located inside each respective enclosure module (20, 30) and traversable by said endless conveyor belt (1), each said compartment defines a flow circuit for each said forced circulation unit and is provided with ventilator means (27, 40) for causing one of the pretreatment fluid and treatment fluid to circulate along the flow circuit of each respective said forced circulation unit, through the textile thread conveyed therethrough, while retaining the fluid in each the respective chamber (7, 8).

9. An apparatus according to claim 8, wherein each forced circulation unit (21) of the pretreatment chamber comprises a substantially closed circuit having dedicated ventilator means (27).

* * * * *